United States Patent [19]

Akkerman

[11] Patent Number: 4,505,331

[45] Date of Patent: Mar. 19, 1985

[54] SIDE POCKET MANDREL

[75] Inventor: Neil H. Akkerman, Houston, Tex.

[73] Assignee: AVA International Corporation, Houston, Tex.

[21] Appl. No.: 440,071

[22] Filed: Nov. 8, 1982

[51] Int. Cl.[3] ..... E21B 23/03

[52] U.S. Cl. ..... 166/117.5

[58] Field of Search ..... 166/117.5, 117.6, 382

[56] References Cited

U.S. PATENT DOCUMENTS 3,874,445 4/1975 Terral ..... 166/117.5

4,333,527 6/1982 Higgins ..... 166/117.5

FOREIGN PATENT DOCUMENTS 864160 3/1961 United Kingdom ..... 166/117.5

*Primary Examiner*—Stephen J. Novosad

*Assistant Examiner*—Michael Starinsky

*Attorney, Agent, or Firm*—Vaden, Eickenroht, Thompson, Bednar & Jamison

[57] ABSTRACT

There is disclosed a side pocket mandrel having upper and lower sections which are adapted to be connected to a well tubing string and which have lower and upper ends, respectively, which are coaxial with one another but with respect to the axes of their upper and lower ends, and an intermediate section adapted to be threadedly connected at its opposite ends to the lower and upper ends, respectively, of the upper and lower sections. The intermediate section is a one-piece body having a first bore formed therein which is substantially axially aligned with the lower and upper ends of the upper and lower sections, respectively, and a second bore formed therein which is parallel to the first bore and open on at least one end to provide a pocket into which a flow-controlling tool may be inserted or from which a flow-controlling tool may be removed.

5 Claims, 3 Drawing Figures

SIDE POCKET MANDREL

Figure 1A:
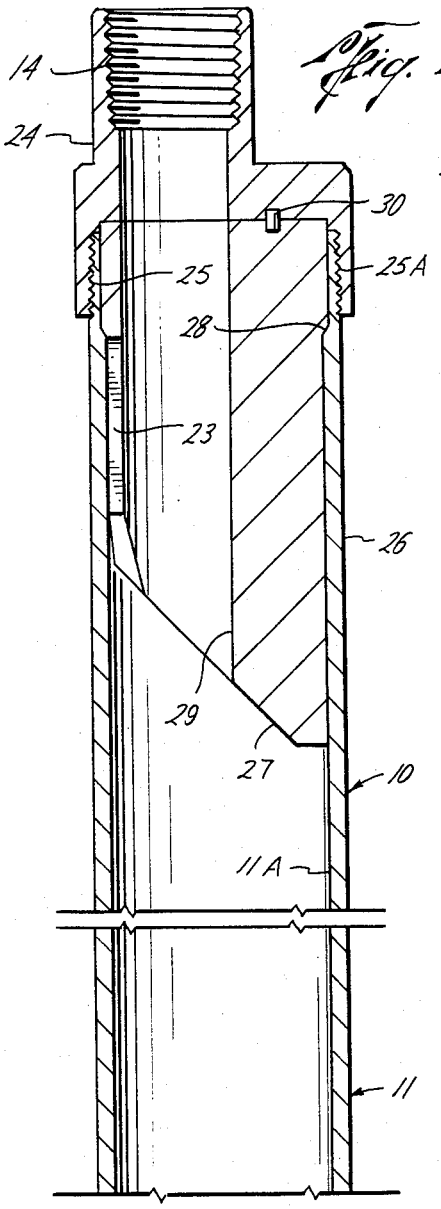

This application relates to improvements in side pocket mandrels.

As well known in the art, a side pocket mandrel is adapted to be connected in a well tubing string for the purpose of receiving a flow controlling tool within a bore forming a "pocket" to one side of a main bore forming a continuation of the well tubing. When so disposed, the flow controlling tool does not interfere with movement of other well tools through the main bore. By way of example, the flow controlling tool may be a gas lift valve for the purpose of stimulating the production of oil through the well tubing, or, as shown in my prior U.S. Pat. No. 4,325,431, it may be a tool for opening or permitting a safety valve within the well tubing to close in response to the pressure of a control fluid supplied to the tool from a remote source.

In any event, at least one end of the pocket opens to the main bore so that the flow controlling tool may be moved by a wire line into or out of the pocket. Also, a port in the body of the mandrel may connect the pocket with the exterior thereof, and the pocket may have polished sections adapted to be engaged by seals about the tool above and below the port. Hence, in the case of a gas lift valve, gas may be injected from the annulus into the well tubing, and, in the case of a safety valve, control fluid may be supplied from the wellhead to pressure responsive means of the flow controlling tool.

As noted in my prior patent, side pocket mandrels are often formed of a pair of side-by-side tubular members, one of which has the main bore formed therein and the other of which has the pocket formed therein. The side of the bored member is slotted along a mid portion of its length to receive one side of the other tubular member, and, when so assembled, the members are welded to one another. However, it may be desirable to form the tubing of a steel whose crystalline structure may be upset by welding. Also, welding of the tubular members may distort them to such an extent that they are misaligned—e.g., the axis of the main bore and pocket are not substantially parallel. In some applications, such as the subsurface safety valve above described, this substantial axial misalignment could interfere with the necessary cooperation between parts movable along the axes of the bore and pocket.

Although the side pocket mandrel shown in my prior U.S. Pat. No. 4,325,431 is entirely void of welds, an intermediate section thereof in which the side pocket is formed requires the fabrication of at least two coaxially arranged parts. Thus, an outer tubular part is threadedly connected to the laterally offset or eccentric ends of upper and lower sections of the mandrel, which are in turn threadedly connected in the well pipe string, and an inner body in which the main bore and side pocket are formed fits closely within and is threadedly connected in a fixed vertical position to the outer tubular part. In addition to increasing the cost of the mandrel, the tubular parts require elastomeric seals between them in order to prevent well fluid from bypassing the bores. These seals as well as the weldments may be damaged in wells having sour gas or high $H_2S$ content.

Higgins et al U.S. Pat. No. 4,333,527 shows a side pocket mandrel having an intermediate section which comprises a one-piece body in which both the main bore and pocket are formed. Although this permits the pocket itself to be formed without so-called "longitudinal structural welds", the upper and lower ends of the intermediate section are connected to the upper and lower sections of the mandrel by circumferential welds. Hence, although having an intermediate section which is of simpler construction and requires no elastomeric seals, this mandrel is susceptible to many of the problems above discussed.

It is therefore the object of this invention to provide a side pocket mandrel which has the advantages, without the disadvantages, of both such side pocket mandrels; and, more particularly, which has an intermediate section which requires no elastomeric seals, but which is nevertheless connected to the upper and lower sections without welds.

This and other objects are accomplished, in accordance with the illustrated embodiment of the invention, by a side pocket mandrel including upper and lower sections having openings therethrough whose upper and lower ends, respectively, are adapted to be connected in substantial axial alignment with a well pipe string, and whose lower and upper ends, respectively, are coaxial with one another but eccentric with respect to the axes of their upper and lower ends, and an intermediate section which comprises a one-piece body whose upper end is threadedly connected to the lower end of the upper section and whose lower end is nonweldably connected to the upper end of the lower section, whereby it is of extremely simplified construction, requiring neither welds nor elastomeric seals. More particularly, the body has a first bore formed therein which is substantially axially aligned with the upper and lower ends of the upper and lower sections, respectively, to permit well tools to pass therethrough, and a second bore formed therein which is substantially parallel to the first bore and open on at least one end to provide a pocket into which a flow controlling tool may be inserted or from which a flow controlling tool may be removed. As illustrated, the lower end of the intermediate section is also threadedly connected to the lower mandrel section, although, in accordance with the broader aspects of this invention, it may be integral therewith.

Preferably, the upper section includes an upper portion having the upper end opening formed therein and a lower tubular end which is eccentric with respect to the upper end, and a lower tubular portion threadedly connected at its upper end to the lower tubular end of the upper portion and at its lower end to the upper end of the body of said intermediate section. More particularly, an insert is closely received within the lower portion and held in a fixed vertical position by an upwardly facing shoulder on the lower portion and a downwardly facing shoulder on the upper portion, the insert having a bore therethrough which is axially aligned with the upper end opening and an alignment slot in one side of the bore cooperable with a wire line running or pulling tool in order to install or retrieve the flow controlling tool.

Figure 1B:
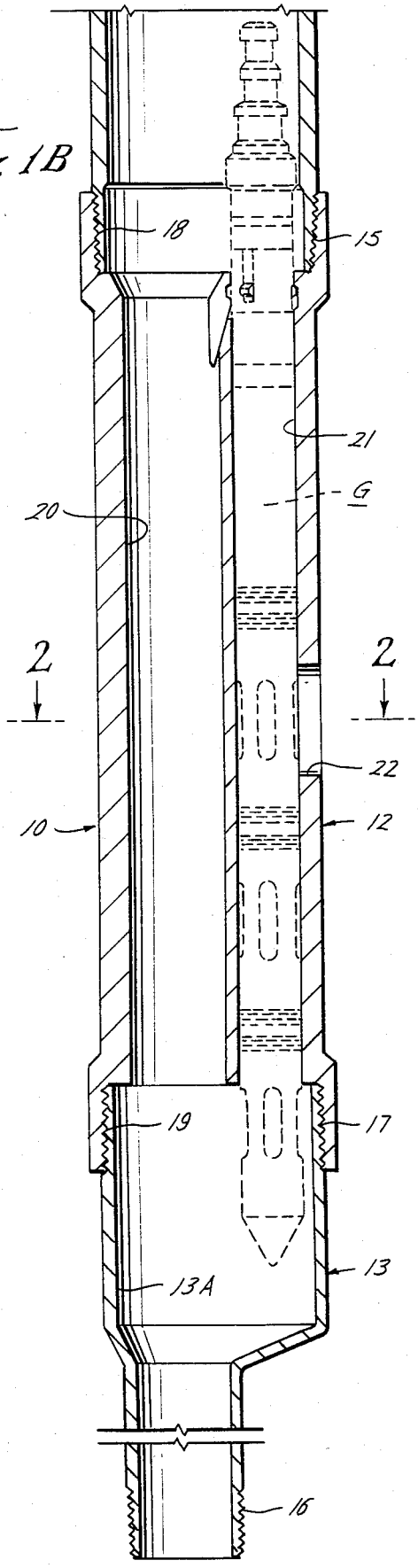
Figure 2:
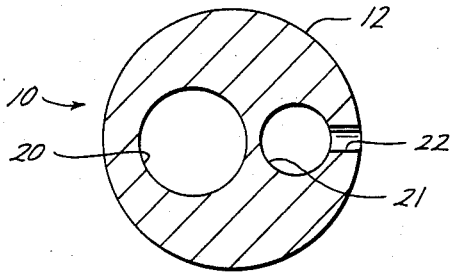

In the drawings, wherein like reference characters are used throughout to designate like parts:

FIGS. 1A and 1B are vertical sectional views of vertically successive portions of the side pocket mandrel, with each such portion being discontinued intermediate its length, and with a gas lift valve shown in broken lines in the position it would occupy in the pocket to one side of the main bore through the intermediate section of the mandrel; and FIG. 2 is a cross-sectional view of the intermediate section, as seen along broken lines 2—2 thereof.

With reference now to the details of the above-described drawings, the overall mandrel, which is indicated in its entirety by reference character 10, is shown in FIGS. 1A and 1B to include upper, intermediate and lower sections 11, 12 and 13, respectively, connected to one another in end-to-end relation. As previously mentioned, and as well known in the art, the mandrel is adapted to be connected in a well tubing string (not shown) disposed within a well bore so as to provide a pocket to one side in which the gas lift valve G or other flow controlling tool may be received. As is well known in the art, a plurality of such mandrels 10 may be connected one above the other within the tubing string.

The upper section 11 has an opening 11A therethrough whose upper end is threaded at 14 for connection with a joint of the well tubing, and whose lower end is threaded at 15 for connection with the upper end of the intermediate section 12, as will be described in detail to follow. Thus, the upper end of the opening is adapted to be connected in substantially axial alignment with the tubing string, while axis of the lower end of the opening is eccentric with respect to the axis of the tubing string.

The lower section 13 is of somewhat similar construction in that it has an opening 13A therethrough whose lower end is threaded at 16 for connection with a joint of the tubing string, and whose upper end is threaded at 17 for connection with the lower end of the intermediate section 12, against as will be described in more detail to follow. More particularly, the lower end of the opening 13A is axially aligned with the upper end of the opening 11A, and thus is adapted to be connected in substantial axial alignment with the tubing string, and the upper end thereof is eccentric to the axis of the lower end of the opening 13A and coaxial with the lower end of opening 11A in the upper section 11.

As previously described, and as shown in the drawings, the intermediate section comprises a one-piece body whose upper end is threaded at 18 for connection with the threaded lower end 15 of the upper section 11, and whose lower end is threaded at 19 for connection with the upper threaded end 17 of the lower section 13. More particularly, the threads 18 and 19 are formed within tubular extensions or necks at the upper and lower ends, respectively, of the section 12 so as to receive the male threaded ends of the upper and lower sections for connection therewith. As shown, the threads are tapered and of such construction as to form sealed connections as they are made up, thus requiring no elastomers.

The portion of the body of the intermediate section intermediate the tubular extensions at its opposite ends has a first bore 20 formed therein which is substantially axially aligned with the openings through the upper and lower ends of the upper and lower sections, and a second bore 21 formed therein which is substantially parallel to the bore 20 and open at its upper end to permit the tool G to be inserted within and retrieved from the side pocket as it is raised and lowered through the tubing and the upper section of the mandrel. The main bore 20 is ordinarily of the same diameter as the openings in the upper and lower ends of the upper and lower sections, respectively, and thus of the well tubing to which the mandrel is connected, whereby well tools may be passed therethrough into and out of the well bore below the mandrel, and is adapted to be aligned with such openings upon full make up of the threaded connections between the sections.

A port 22 is formed in the intermediate section of the mandrel to connect its exterior with the pocket formed by the bore 21. In addition, at least those portions of the pocket above and below the port are polished and thus adapted to be sealably engaged by seal rings carried about the tool G above and below the port. Thus, as shown in broken lines in FIG. 1B, ports in the tool G leading to the interior of the tool G are fluidly connected with mandrel ports 22, whereby, as well known in the art the tool functions to control flow between the annulus about the well tubing and the interior thereof. Thus, for example, in the case of a conventional gas lift valve, gas may be injected from the annulus into the well tubing in order to enhance the recovery of the production of oil therethrough.

The eccentric lower portion of the upper section 11 is of sufficient length to permit the tool G to be run on a wire line into or out of the pocket through the open end of the bore 21. In the illustrated embodiment of the invention, the lower end of the bore 21 is also open to permit the lower end of tool G to extend therethrough, and the eccentric portion of the lower section 13 is of sufficient length to accommodate the lower extension of the tool.

As well known in the art, the tool G has an upper bushing neck so that it may be inserted within or removed from the pocket by means of suitable running and pulling tools suspended from the wire line. In order to properly orient the lower end of the tool G for entry into or removal through the upper end of the pocket, a slot 23 is provided in the upper section 11 for cooperation with the running or pulling tool. In the illustrated embodiment of the invention, the upper section 11 or the mandrel is of such construction as to permit this slot to be formed within a replaceable and readily assembled part which may be mounted as to dispose the slot in the properly oriented position without welding.

For this purpose, the section 11 includes a neck portion 24 having the upper end of opening 11A formed therein, and a lower tubular end which is eccentric with respect to the axis of the upper end of the opening and which has female threads 25 formed therein for connection with male threads 25A about the upper end of a lower, tube-like portion 26 whose lower end has the threads 15 formed thereon for connection with the intermediate section 12. An insert 27 fits closely within the upper end of the tube 26 and is held with its upper end against the lower end face of the upper section portion 24 by means of an upwardly facing shoulder 28 about the tube 26 as the threads 25 and 25A are made up. A bore 29 through the insert is held in axial alignment with the upper end of opening 11A by means of a pin 30 located in aligned holes in the insert and upper section portion 24. As shown in FIG. 1A, the lower end of the insert tapers upwardly toward the side of the insert in which bore 29 is formed, therefore facilitating guiding of the upper end of the tool G into the bore 29.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations.

This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A side pocket mandrel, comprising upper and lower, non-welded sections having openings therethrough whose upper and lower ends, respectively, are adapted to be connected in substantial axial alignment with a well pipe string, and whose lower and upper ends, respectively, are coaxial with one another but eccentric with respect to the axes of their upper and lower ends, and an intermediate, non-welded section comprising a body whose upper end is threadedly connected to the lower end of the upper section and whose lower end is threadedly connected to the upper end of the lower section, said body having a first bore formed therein which is substantially axially aligned with the upper and lower ends of the upper and lower sections, respectively, to permit well tools to pass therethrough, and a second bore formed therein which is parallel to the first bore and open on at least one end to provide a pocket into which a flow-controlling tool may be inserted or from which a flow-controlling tool may be removed, and means in the upper section having orienting means which, when the sections are threadedly and sealably connected to one another, occupies a predetermined rotational position with respect to the pocket.

2. A mandrel of the character defined in claim 1, wherein the means providing the orienting means comprises an insert received within the upper section and having a bore therethrough, and means connecting the insert to the upper section, when so received, to align its orienting means with the opening in the upper end of the upper section.

3. A mandrel of the character defined in claim 1, wherein the upper section includes an upper portion having the upper end opening formed therein and a lower tubular end eccentric with respect to the upper end, a lower tubular portion threadedly connected at its upper end to the lower tubular end of the upper portion and at its lower end to the upper end of the body of said intermediate section, and an insert closely received within the lower portion and held in a fixed vertical position by an upwardly facing shoulder on the lower portion and a downwardly facing shoulder on the upper portion, said insert having a bore therethrough axially aligned with the upper end opening and an alignment slot in one side of the bore.

4. A side pocket mandrel, comprising upper and lower, non-welded sections having openings therethrough whose upper and lower ends, respectively, are adapted to be connected in substantial axial alignment with a well pipe string, and whose lower and upper ends, respectively, are coaxial with one another but eccentric with respect to the axes of their upper and lower ends, and an intermediate, non-welded section comprising a body whose upper end is threadedly connected to the lower end of the upper section and whose lower end forms a cylindrical continuation of the upper end of the lower section, said body having a first bore formed therein which is substantially axially aligned with the upper and lower ends of the upper and lower sections, respectively, to permit well tools to pass therethrough, and a second bore formed therein which is parallel to the first bore and open on at least one end to provide a pocket into which a flow-controlling tool may be inserted or from which a flow-controlling tool may be removed and means in the upper section having orienting means which, when the upper and intermediate sections are threadedly and sealably connected to one another, occupies a predetermined rotational position with respect to the pocket.

5. A mandrel of the character defined in claim 4, wherein the means providing the orienting means comprises an insert received within the upper section and having a bore therethrough, and means connecting the insert to the upper section, when so received, to align its orienting means with the opening in the upper end of the upper section.

* * * * *